United States Patent [19]

Wittchow et al.

[11] 4,063,522

[45] Dec. 20, 1977

[54] BURNER INSTALLATION IN A STEAM GENERATOR WITH FIRING MEANS FOR PULVERIZED COAL AND GAS

[75] Inventors: Eberhard Wittchow; Rudolf Kral, both of Erlangen, Germany

[73] Assignee: Kraftwerk Union Aktiengesellschaft, Mulheim (Ruhr), Germany

[21] Appl. No.: 689,568

[22] Filed: May 24, 1976

[30] Foreign Application Priority Data

May 30, 1975 Germany ..... 2523852

[51] Int. Cl.[2] ..... F23C 1/12

[52] U.S. Cl. ..... 110/22 A; 110/28 R; 431/2

[58] Field of Search ..... 110/22 R, 22 A, 28 R; 431/2, 5

[56] References Cited

U.S. PATENT DOCUMENTS

| | | | |
|---|---|---|---|
| 2,807,242 | 9/1957 | Poole | 110/22 |
| 3,135,314 | 6/1964 | Brunner | 110/22 |
| 3,391,675 | 7/1968 | Hoare | 110/22 |
| 3,395,657 | 8/1968 | Schuss | 110/22 |

*Primary Examiner*—Kenneth W. Sprague
*Attorney, Agent, or Firm*—Herbert L. Lerner

[57] ABSTRACT

Burner installation in a steam generator having means for firing pulverized coal as well as gas, includes a combustion chamber of substantially rectangular cross section, at least three pulverized coal-burners disposed mutually adjacent one another in cross-sectional direction of the combustion chamber on a first wall of the combustion chamber at least one of the pulverized coal-burners being located between others thereof, gas burners located on at least another wall of the combustion chamber located adjacent the first wall thereof, the pulverized coal burners being located at an elevation of the combustion chamber above the gas burners, the at least one of the pulverized coal-burners being operable only if gas is not being burned simultaneously therewith by the gas burners.

3 Claims, 4 Drawing Figures

Figure 1:
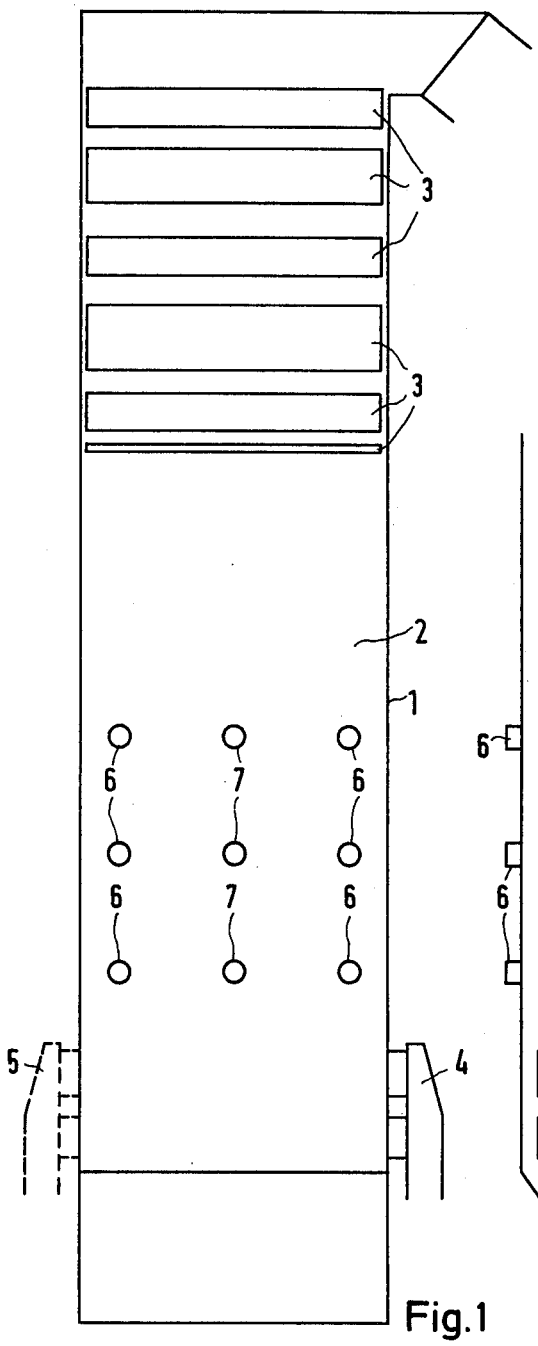

BURNER INSTALLATION IN A STEAM GENERATOR WITH FIRING MEANS FOR PULVERIZED COAL AND GAS

The invention of the instant application relates to a burner installation for a steam generator having a substantially rectangular combustion chamber, wherein gas burners are provided in addition to pulverized-coal burners. Especially when lean gas (gas with a low heating value, such as stack gas or blast-furnace gas, for example) is burned, large quantities of inert gas are produced which can have an adverse effect on the simultaneous combustion of other fuels in the same combustion chamber. When the stack gases of pulverized-coal and lean-gas burners are intensively mixed, the effect of the quantities of inert gas produced by the combustion is that the radiation conditions in the combustion chamber are subjected to large variations and, in addition, the combustion of the pulverized coal is adversely affected.

It is an object of the invention of the instant application to provide a burner installation of the foregoing type which avoids the foregoing disadvantages of heretofore known installations of this general type. More specifically, it is an object of the invention to ensure that, in a common combustion chamber, uniform heating of the combustion chamber walls and also undisturbed combustion of the pulverized coal even in the presence of large quantities of inert gas will occur both when the pulverized-coal burners are operated alone as well as when the pulverized-coal and the gas burners are operated simultaneously.

With the foregoing and other objects in view, there is provided, in accordance with the invention, a burner installation in a steam generator having means for firing pulverized coal as well as gas, comprising a combustion chamber of substantially rectangular cross section, at least three pulverized coal-burners disposed mutually adjacent one another in cross-sectional direction of the combustion chamber on a first wall of the combustion chamber, at least one of the pulverized coal-burners being located between others thereof, gas burners located on at least another wall of the combustion chamber located adjacent the first wall thereof, the pulverized coal burners being located at an elevation of the combustion chamber above the gas burners, the at least one of the pulverized coal-burners being operable only if gas is not being burned simultaneously therewith by the gas burners.

In accordance with another feature of the invention, at least three of the pulverized coal-burners are located on each of at most two mutually opposing walls of the combustion chamber, the gas burners being located on the wall of the combustion chamber located adjacent the two mutually opposing walls thereof.

In accordance with a further feature of the invention, the burner installation includes a partition disposed in the combustion chamber transversely to the cross-sectional direction thereof and to the first wall, an even-number quantity consisting of a least four of the pulverized coal burners being disposed adjacent one another on the first wall on opposite sides of the partition, at least one of the pulverized coal burners being located between the partition and others of the pulverized coal burners on each side of the partition, the pulverized coal burners having respective inlet flow pasageways extending into the combustion chamber in a direction substantially parallel to the plane of the partition, at least the pulverized coal burners located between the partition and the respective others of the pulverized coal burners on each side of the partition being inoperative when the gas burners are being operated.

Other features which are considered as characteristic for the invention are set forth in the appended claims.

Although the invention is illustrated and described herein as embodied in a burner installation in a steam generator with firing means for pulverized coal and gas, it is nevertheless not intended to be limited to the details shown, since various modifications and structural changes may be made therein without departing from the spirit of the invention and within the scope and range of equivalents of the claims.

Figure 2:
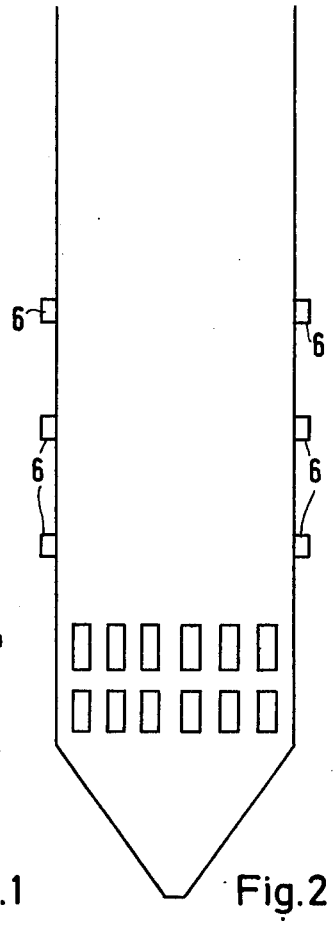
Figure 3:
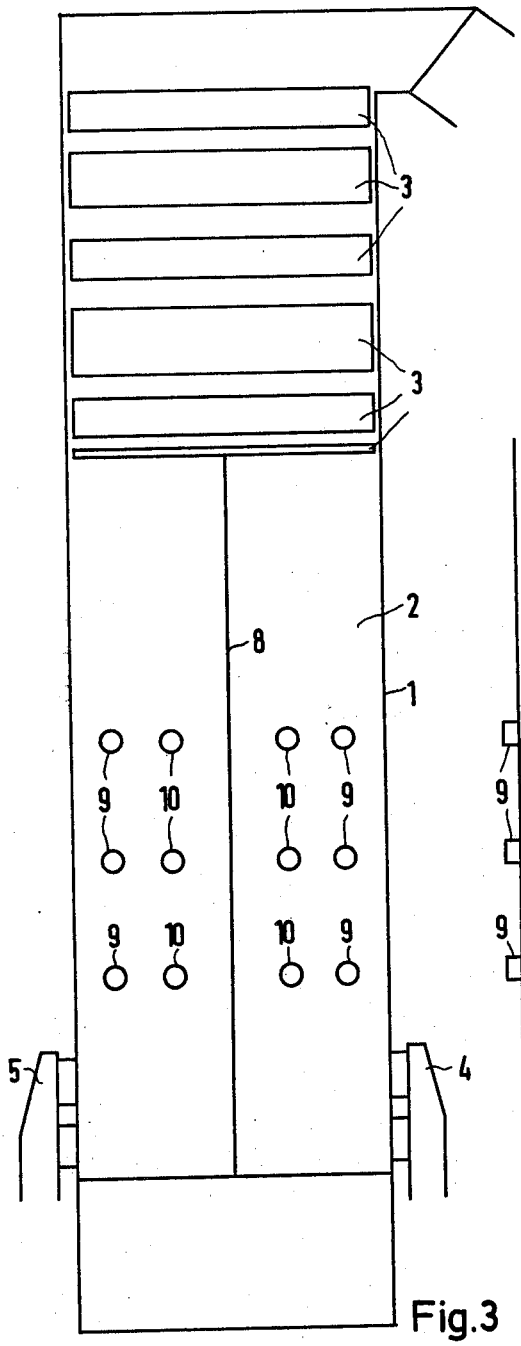
Figure 4:
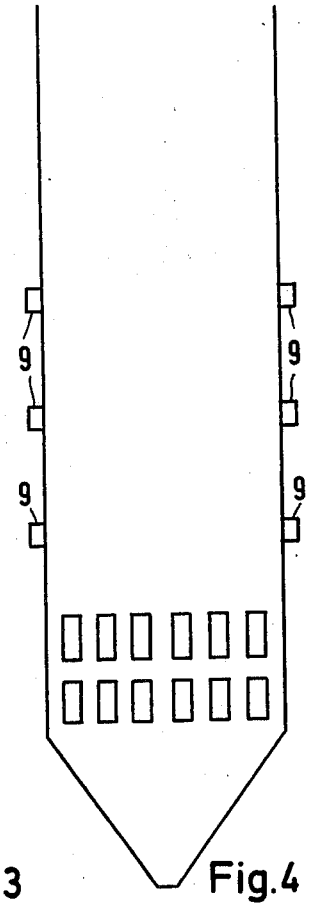

The construction and method of operation of the invention, however, together with additional objects and advantages thereof will be best understood from the foregoing description of specific embodiments when read in connection with the accompanying drawings, in which:

FIGS. 1 and 2 are diagrammatic front and side elevational views, respectively, of the burner installation having firing means both for pulverized coal and for gas, in accordance with the invention; and FIGS. 3 and 4 are views similar to FIGS. 1 and 2, resepctively, of another embodiment of the invention having a steam generator, the combustion chamber of which is provided with a middle partition.

Referring now to the drawing, and first, particularly to FIGS. 1 and 2, thereof, there is shown diagrammatically, a steam generator 1 with a combustion chamber 2 and convection heating surfaces 3. In the lower part of the combustion chamber 2, gas burners 4 and 5 are provided on mutually opposing sides. Above the gas burners 4 and 5, the front and rear sides of the combustion chamber 2 are equipped with three rows of pulverized-coal burners 6 and 7. The pulverized-coal burners 6 are located to the outside of the front and rear sides of the combustion chamber 2, while the pulverized-coal burners 7 are disposed in the middle thereof between the pulverized-coal burners 6. The direction of flow of the pulverized coal into the pulverized-coal burners 6 and 7 and consequently the direction of blast thereof is offset 90° relative to the blast direction of the gas burners 4 and 5. In FIG. 1, the gas burner 5 is shown in broken lines to indicate that it may be sufficient merely to provide only a single gas burner 4. The same applies to the pulverized-coal burners 6 and 7 which may be disposed either on only one wall surface or on two opposite wall surfaces of the combustion chamber 2.

If the steam generator is heated by pulverized coal only, all of the pulverized-coal burners 6 and 7 are in operation and ensure uniform heating of all the wall surfaces of the combustion chamber 2. If lean gas is to be burned at the same time, the pulverized-coal burners 7 are shut off. The large quantities of inert gas produced during combustion of the fuel gas can therebo flow upwardly in the middle of the combustion chamber 2, virtually unhindered by the stack gases of the pulverized-coal burners 6. There is practically no mixing of the stack gases, so that neither the combustion of the pulverized coal is affected adversely, nor the heating of the combustion chamber walls rendered nonuniform.

In a steam generator with a middle partition 8, as shown diagrammatically in FIGS. 3 and 4, it is advantageous, in accordance with another embodiment of the invention, to dispose the pulverized-coal burners 9 and 10 so that the direction of blast thereof is parallel to the plane of the middle partition 8 i.e. perpendicularly to the plane of the drawing. It is advantageous, in this regard, to install an even number and at least four pulverized-coal burners 9 and 10 adjacent one another so that the two sets of middle pulverized-coal burners 10, as shown in FIG. 3, are shut off when the gas burners 4 and 5 are in operation.

There are claimed:

1. Burner installation in a steam generator having means for firing pulverized coal as well as gas, comprising a combustion chamber of substantially rectangular cross section, at least three pulverized coal-burners disposed mutually adjacent one another in cross-sectional direction of said combustion chamber on a first wall of said combustion chamber, at least one of said pulverized coal-burners being located between others thereof, gas burners located on at least another wall of said combustion chamber located adjacent said first wall thereof, said pulverized coal burners being located at an elevation of said combustion chamber above said gas burners, said pulverized coal-burners, on the one hand, and said gas burners, on the other hand, having means for introducing pulverized coal and gas, respectively, thereto in directions substantially perpendicular to one another, said others of said pulverized coal-burners being operable independently of said at least one of said pulverized coal-burners and being mutually disposed so far apart that a space free of combustion gas therefrom is located therebetween.

2. Burner installation according to claim 1 wherein at least three of said pulverized coal-burners are located on each of at most two mutually opposing walls of said combustion chamber, said gas burners being located on the walls of said combustion chamber located adjacent said two mutually opposing walls thereof.

3. Burner installation in a steam generator having means for firing pulverized coal as well as gas, comprising a combustion chamber of substantially rectangular cross section, at least three pulverized coal-burners disposed mutually adjacent one another in cross-sectional direction of said combustion chamber on a first wall of said combustion chamber at least one of said pulverized coal-burners being located between others thereof, gas burners located on at least another wall of said combustion chamber located adjacent said first wall thereof, said pulverized coal burners being located at an elevation of said combustion chamber above said gas burners, a partition disposed in said combustion chamber transversely to said cross-sectional direction thereof and to said first wall, an even-number quantity conisting of at least four of said pulverized coal burners being disposed adjacent one another on said first wall on opposite sides of said partition, at least one of said pulverized coal burners being located between said partition and others of said pulverized coal burners on each side of said partition, said pulverized coal burners having respective inlet flow passageways extending into said combustion chamber in a direction substantially parallel to the plane of said partition.

* * * * *